US005634176A

United States Patent [19]

Ayash et al.

[11] Patent Number: 5,634,176

[45] Date of Patent: May 27, 1997

[54] APPARATUS FOR DISTRIBUTING AIR FLOW IN A PRINTING MACHINE

[75] Inventors: Karl B. Ayash, Webester; Thomas C. Hollar, Penfield, both of N.Y.

[73] Assignee: Xerox Corporation, Stamford, Conn.

[21] Appl. No.: 548,927

[22] Filed: Oct. 26, 1995

[51] Int. Cl.[6] ..... G03G 21/20

[52] U.S. Cl. ..... 399/92

[58] Field of Search ..... 355/200, 202, 355/210, 215, 282, 285; 399/91, 92, 107, 110

[56] References Cited

U.S. PATENT DOCUMENTS 4,093,368 6/1978 Nishikawa .
4,154,521 5/1979 Tanaka .
4,530,589 7/1985 Adams .
5,185,629 2/1993 Iino et al. .
5,291,247 3/1994 DeCecca .
5,424,806 6/1995 Siegel .
5,471,280 11/1995 Taguchi .
5,481,339 1/1996 De Cock et al. .

*Primary Examiner*—Sandra L. Brase
*Attorney, Agent, or Firm*—H. Fleischer; J. E. Beck; R. Zibelli

[57] ABSTRACT

A printing machine of the type having a plurality of components for printing a document is disclosed. The printing machine includes an air source and a support member having a component mounted thereon. The support member is coupled to the air source which has output ports so that air flows from the output ports.

8 Claims, 4 Drawing Sheets

APPARATUS FOR DISTRIBUTING AIR FLOW IN A PRINTING MACHINE

This invention relates generally to an air flow distribution system in an electrophotographic printing machine. More specifically, the invention relates to incorporating an air system manifold requirement into another machine component so as to combine the manifold and component functions together.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern known as a latent image. The latent image is developed by contacting it with a dry or liquid developer material having a carrier and toner. The toner is attracted to the image areas and held thereon by the electrostatic charge on the photoreceptor surface. Thus, a toner image is produced in conformity with a light image of the original being reproduced. The toner image is transferred to a copy sheet, and the image affixed thereto to form a permanent record of the image to be reproduced. Subsequent to development, excess toner left on the photoreceptor is cleaned from its surface. The process is useful for light lens copying from an original document or for printing electronically generated or stored originals such as with a raster output scanner (ROS), where a charged surface may be imagewise discharged in a variety of ways.

The foregoing discussion generally describes a typical black and white or single color electrophotographic printing process. The approach utilized for multicolor electrophotographic printing is substantially identical. However, instead of forming a single latent on the photoreceptor, multiple latent images corresponding to different color separations are sequentially recorded on the photoreceptor. Each single color latent image is developed with toner complimentary thereto. This process is repeated for each of the differently colored images with a respective toner of a complimentary color. Thereafter, each single color toner image is transferred to the copy sheet in superimposed registration with the prior toner image, creating a multi-layered toner image. This multi-layered toner image is permanently affixed to the copy sheet in a conventional manner to form a finished color copy.

An electrophotographic printing machine uses compressed air for operations involving print transportation, fusing, and finishing. In addition, image writing systems and corona discharge devices are influenced by the buildup of airborne contaminates and heat. The effects are reduced by providing an even distribution of air around the critical components for cooling and cleaning.

Current machine designs separate air system components from other machine components which otherwise could serve a second function in the air system. This practice results in an additional parts count and space requirement for the overall machine. Creating a unified design that combines the air system manifold requirement with another machine component reduces the parts count, simplifies manufacturing and field service interfaces, and enhances space utilization.

In accordance with one aspect of the invention, there is provided a printing machine of the type having a plurality of components for printing a document. The printing machine includes an air source and a support member having a component mounted thereon. The support member is coupled to the air source which has output ports so that air flows from the output ports.

In accordance with yet another aspect of the invention, there is provided an air manifold system for performing a dual function of supplying air flow to a plurality of components and supporting a component of the plurality of components. The air manifold system includes an air source and a support member having a component mounted thereon. The support member is coupled to the air source which has output ports so that air flows from the output ports to the components.

Figure 1:
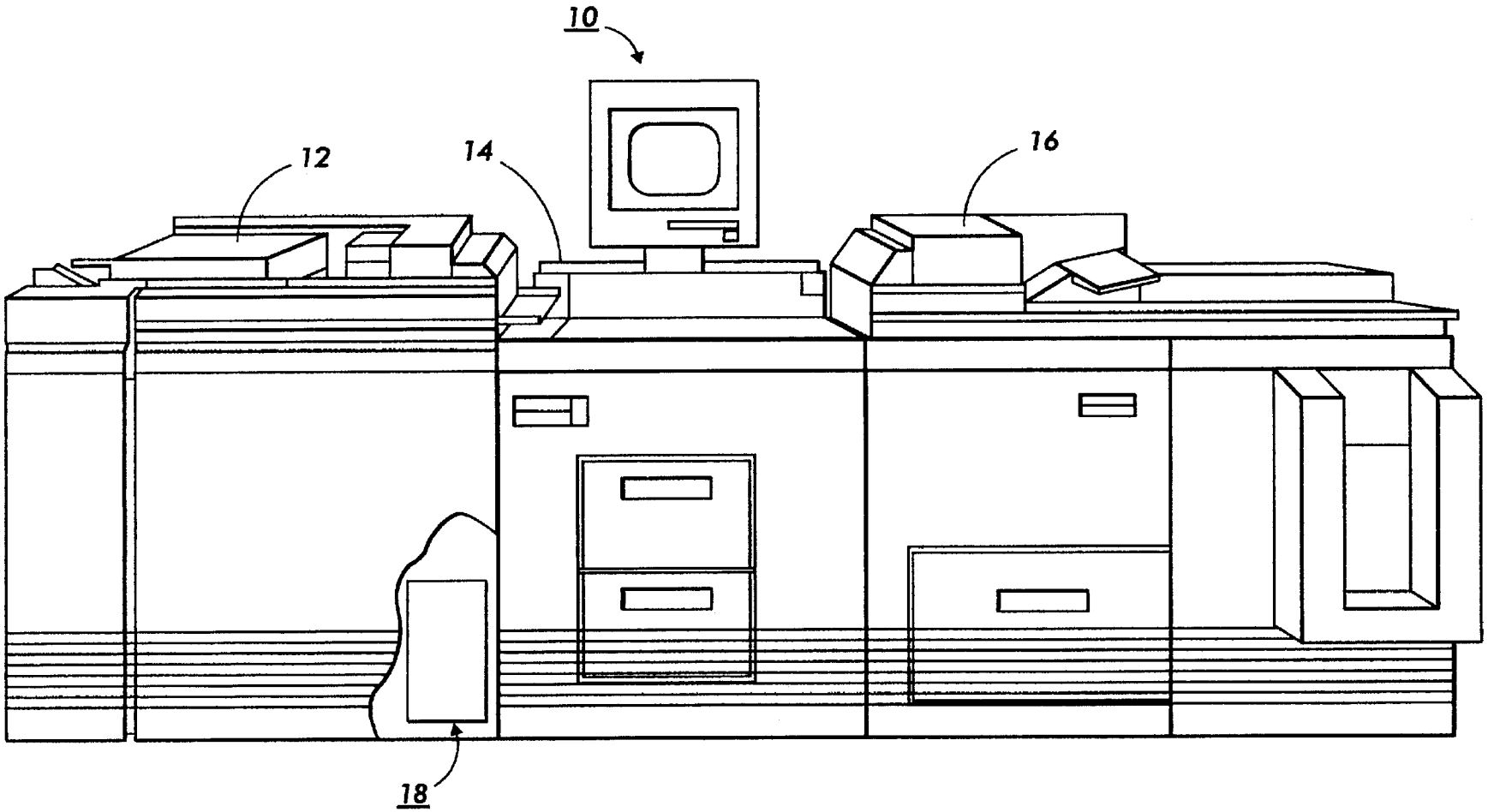
FIG. 1 is a perspective view of an illustrative printing machine incorporating the air flow system therein.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the present invention, reference is made to the drawings. In the drawings, like reference numerals have been used throughout to designate identical elements. It will become evident from the following discussion that the air manifold of the present invention is equally well suited for use in a wide variety of printing machines and is not necessarily limited in its application to the particular embodiment depicted herein.

Turning now to FIG. 1 a printing machine 10 is shown comprised of a marking-imaging module 12, a copy handling module 14, and a finishing module 16. An air flow system 18, mounted in the lower right rear corner of the marking-imaging module 12, provides air to system components located in both the marking-imaging module 12 and the finishing module 16. At the start of a printing job, machine control logic (not shown) activates air flow system 18 by applying power thereto. The control logic deactivates air flow system 18 during the cycle down sequence at the end of a print job. While air flow system 18 is activated, air is delivered to the patch generator, the electrostatic voltmeter, and the prefuser transport sensor, all of which are located in the marking-imaging module 12. In the finishing module 16, air is distributed to the stacker, bins, and stitcher.

Figure 2:
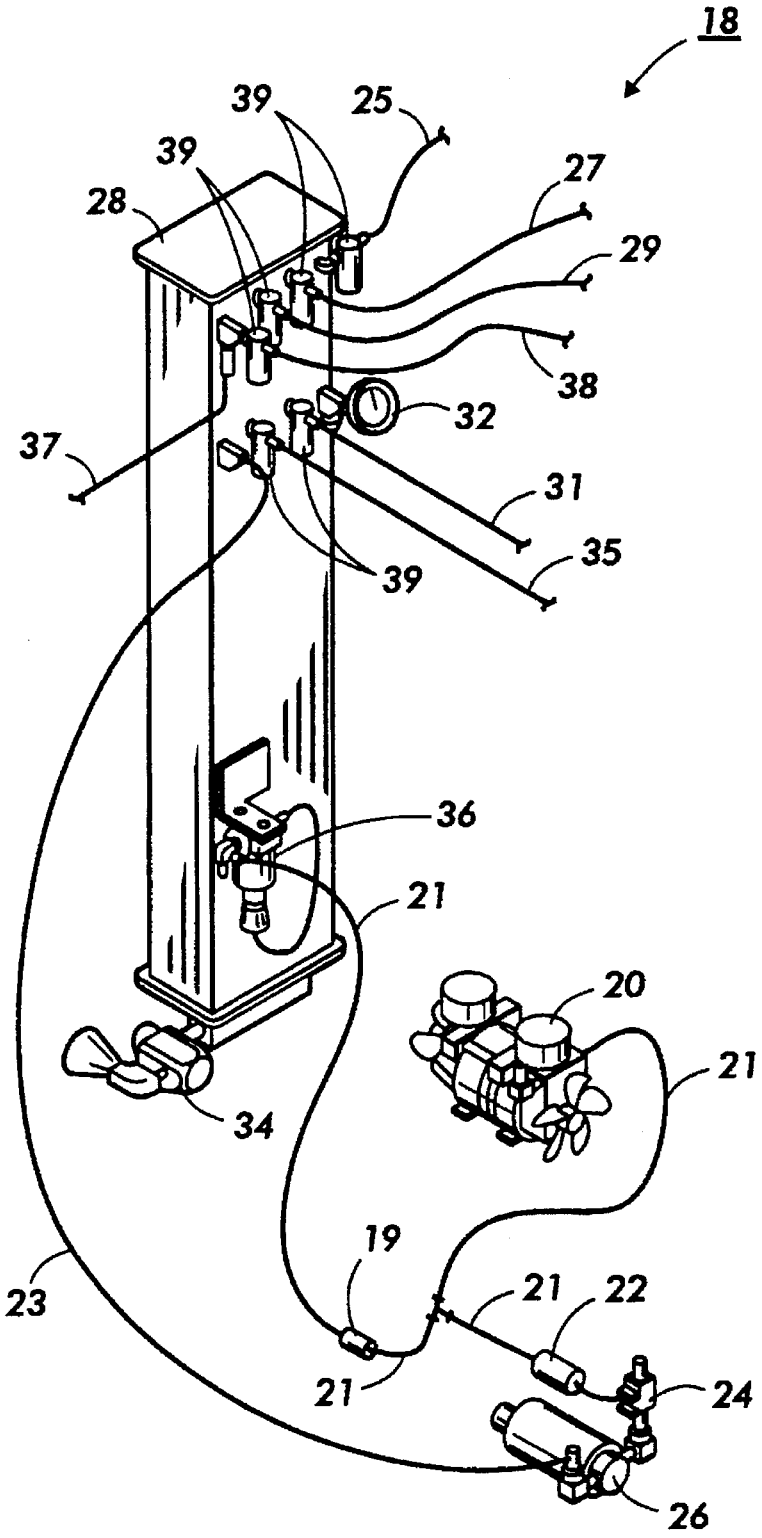
FIG. 2 is a schematic perspective view of an air flow system used in the FIG. 1 printing machine.

Moving now to a more detailed description of air flow system 18, FIG. 2 shows a typical system suitable for use in the FIG. 1 printing machine. Referring to FIG. 2, the air supply is produced by a compressor motor 20 having an air intake which is not shown. The compressed air is delivered to an accumulator tank 28 via an input air line 23 and stored therein to ensure a constant and stable air supply during peak operation of the air system 18. The compressor motor 20 works to produce a system pressure of approximately 44 psi. Air compressed by motor 20 flows through an air line 21 to moisture filter 36 and an exhaust mechanism comprising an exhaust valve 24 and an air dump solenoid 26. Pressure in air line 21 is relieved to 0 psi when compressor motor 20 is turned off. The pressure bleeds off to the atmosphere through the exhaust valve 24 energized by the air dump solenoid 26. In-line check valves 19 and 22 prevent a loss of air pressure in accumulator tank 28 due to back flow through compressor motor 20 and valve 24. Preventing air loss by back flow eliminates the wait for the system to increase pressure every time an air component in the marking-imaging module (FIG. 1) or the Finisher (FIG. 1) is needed during a print run. Air pressure in the accumulator tank 28 is measured by an air gauge 32 and maintained by a relief valve 34. When the pressure reaches approximately 44 psi, the relief valve 34 opens so as to remove the excess to the atmosphere. The supply of air in accumulator tank 28 is distributed throughout the marking-imaging module (FIG. 1) and finisher (FIG. 1) by different size output air lines 25, 27, 29, 31, 35, 37, and 38 respectively. Each of the output air lines is connected to the accumulator tank 28 via an output valve 39 operated by a companion solenoid (not shown). One skilled in the art will appreciate that the accumulator tank 28 is an air manifold, wherein input air line 23 is connected to a plurality of outlets having air lines 25, 27, 29, 31,35, 37, and 38 connected thereto.

Figure 3:
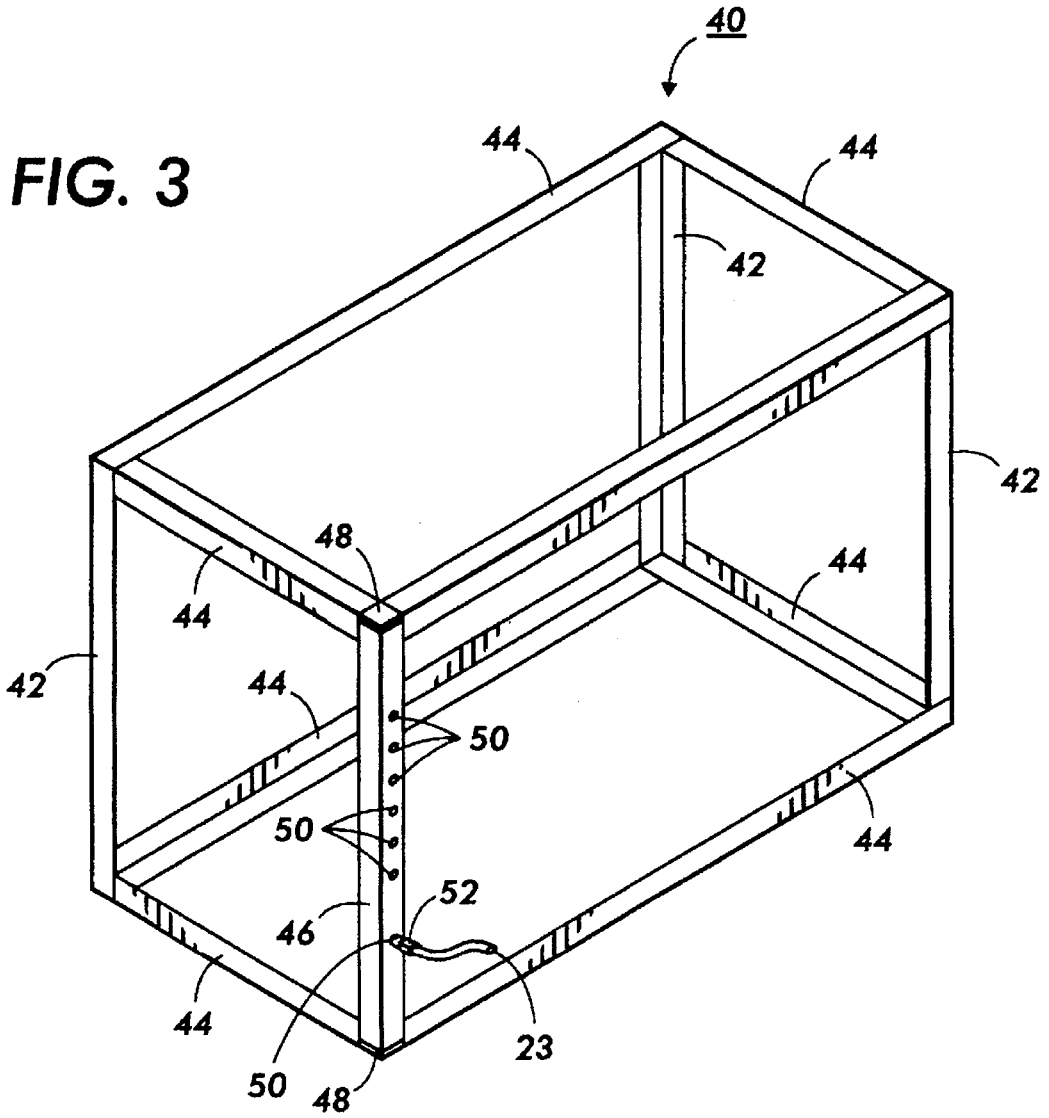
FIG. 3 is a schematic perspective view of an air manifold requirement of the air flow system being incorporated into a machine module frame member.

Referring to FIG. 3, there is shown an embodiment of the present invention wherein a frame member performs a dual function. One function being that of supplying air flow to a plurality of components and the other function is that of supporting at least one component. In FIG. 3, frame assembly 40 forms the rigid superstructure of the marking-imaging module 12 (FIG. 1). It is the structural base on which all necessary components are located so that the module may perform marking and imaging operations. One skilled in the art will appreciate that frame assembly 40 may also represent the superstructure of the other printing machine modules as well. The frame assembly 40 is made up of a plurality of elongated horizontal members 44 and vertical members 42 which may be of an angle stock material such as steel. At least one vertical member 46 is formed from a hollow square tube having a dimension of approximately 3 inches per side, at the openings, on each end. The opposing ends of the vertical member 46 are capped, by caps 48, to form a chamber. A plurality of apertures 50 along the frame member length are applied thereto to form an input port and multiple output ports. Each aperture 50 accepts fittings that attach to air lines. A single input air line 23, for example, is connected by a fitting 52 to the lower most aperture 50 for bringing air from an air source (not shown) into the frame member. In a similar manner, output air lines (not shown) may be connected to other fittings (not shown) so as to distribute air to required components (not shown) located throughout the module enclosed by frame 40. The exact number of apertures 50 is determined by the total number of required output ports, plus a single input port.

Figure 4:
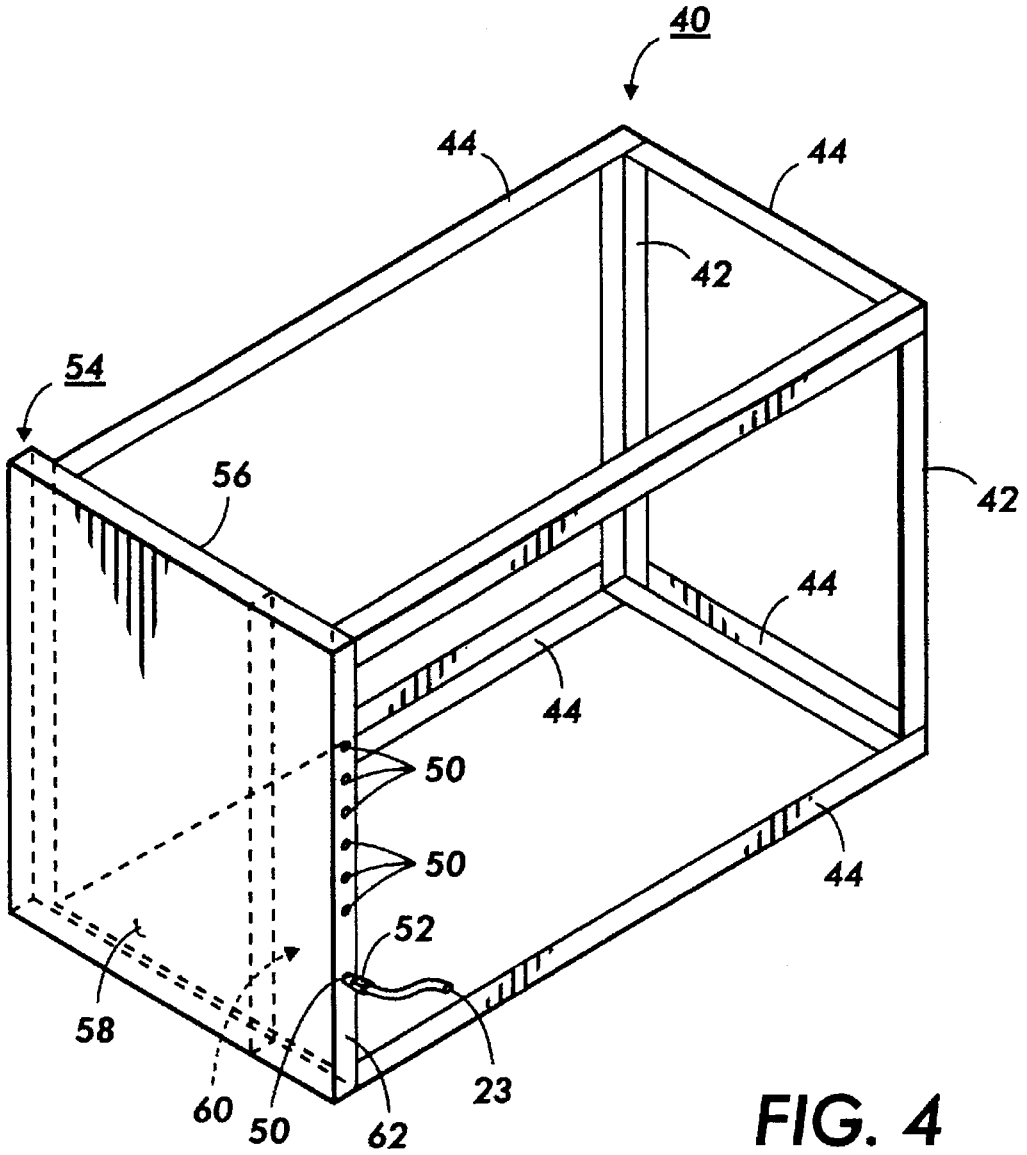
FIG. 4 is a schematic perspective view of an air manifold requirement of the air flow system being incorporated into a machine module cover.

Referring to FIG. 4, there is shown another embodiment of the present invention wherein a cover performs a dual function. One function being that of supplying air flow to a plurality of components and the other function is that of concealing the frame assembly. In FIG. 4, frame assembly 40 which forms the rigid superstructure of the module has a front, movable cover 54 attached thereto. The cover 54 is of at least a two-piece construction having a front wall 58 and a rear wall 56 defining a chamber 60 therebetween. A plurality of apertures 50 located along the length of a cover edge 62 are applied thereto to form an input port and multiple output ports. Each aperture 50 accepts fittings that attach to air lines. A single input air line 23, for example, is connected by a fitting 52 to the lower most aperture 50 for bringing air from an air source (not shown) into the cover. In a similar manner, output air lines (not shown) may be connected to other fittings (not shown) so as to distribute air to required components (not shown) located throughout the module enclosed by frame 40. The exact number of apertures 50 is determined by the total number of required output ports, plus a single input port. Although the front frame cover is combined with an air manifold design, one skill in the art will appreciate that other covers used to enclose frame 40 may be combined with the manifold function as well.

In recapitulation, the present invention is directed to an air flow distribution system, wherein the manifold is incorporated with support members so as to combine the manifold and support member functions together. In one embodiment, the manifold is combined with a frame member and in another embodiment, it is combined with a frame cover.

It is, therefore, evident that there has been provided, in accordance with the present invention, an air system manifold that fully satisfies the aims and advantages of the invention as hereinabove set forth. While the invention has been described in conjunction with preferred embodiments thereof, it is evident that many alternatives, modifications, and variations may be apparent to those skilled in the art. Accordingly, it is intended to embrace all such alternatives, modifications, and variations which are within the spirit and broad scope of the appended claims.

We claim:

1. A printing machine of the type having a plurality of components for printing a document including:

an air source; and a support member having a component mounted thereon, said support member being coupled to said air source and having output ports so that air flows from the output ports, said support member includes a cover defining a chamber connected to the output ports and having an input port connected to said air source and the chamber therein.

2. A printing machine according to claim 1, wherein said support member includes a frame defining a chamber connected to the output ports and to said air source.

3. A printing machine according to claim 2, wherein said frame includes:

a tube having output ports therein and an input port connected to said air source; and caps for sealing opposed ends of said tube.

4. A printing machine according to claim 1, wherein said support member includes a frame having said cover mounted movably thereon.

5. An air manifold system for performing a dual function of supplying air flow to a plurality of components and supporting a component of the plurality of components, including:

an air source; and a support member have the components mounted thereon, said support member being coupled to said air source and having output ports so that air flows from the output ports to the components, said support member includes a cover defining a chamber connected to the output ports and having an input port connected to said air source and the chamber therein.

6. An air manifold system according to claim 5, wherein said support member includes a frame defining a chamber connected to the output ports and to said air source.

7. An air manifold system according to claim 6, wherein said frame includes:

a tube having output ports therein and an input port connected to said air source; and caps for sealing opposed ends of said tube.

8. An air manifold system according to claim 5, wherein said support member includes a frame having said cover mounted movably thereon.

* * * * *